US007721447B2

(12) United States Patent
Co

(10) Patent No.: US 7,721,447 B2
(45) Date of Patent: May 25, 2010

(54) HAND-HELD CUTTER WITH AUTOMATIC BLADE CHANGER

(75) Inventor: Victor Co, Kowloon (HK)

(73) Assignee: Cosimex (H.K.) Limited, Kowloon (HK)

( * ) Notice: Subject to any disclaimer, the term of this patent is extended or adjusted under 35 U.S.C. 154(b) by 161 days.

(21) Appl. No.: 11/693,746

(22) Filed: Mar. 30, 2007

(65) Prior Publication Data

US 2008/0141539 A1 Jun. 19, 2008

(30) Foreign Application Priority Data

Dec. 15, 2006 (CN) ..... 2006 2 0165673 U

(51) Int. Cl.
*B26B 3/00* (2006.01)
*B65D 83/10* (2006.01)

(52) U.S. Cl. ..... 30/124; 30/329; 30/339; 206/349; 206/354; 206/355; 206/359

(58) Field of Classification Search ..... 30/124, 30/151, 329, 332, 335, 339, 340; 206/349, 206/354–357, 359, 363, 372, 374, 553; 29/235, 29/239, 270, 278, 808; 606/167
See application file for complete search history.

(56) References Cited

U.S. PATENT DOCUMENTS 3,106,017 A * 10/1963 Milbrandt ..... 30/32
4,106,620 A * 8/1978 Brimmer et al. ..... 206/363
4,120,397 A * 10/1978 Neumann ..... 206/356
4,344,532 A * 8/1982 Eldridge et al. ..... 206/359
4,386,457 A * 6/1983 Coombs ..... 29/235
4,395,807 A * 8/1983 Eldridge et al. ..... 29/239
4,730,376 A * 3/1988 Yamada ..... 29/239
4,746,016 A * 5/1988 Pollak et al. ..... 206/356
4,903,390 A * 2/1990 Vidal et al. ..... 29/239
4,985,034 A * 1/1991 Lipton ..... 606/167
4,998,334 A * 3/1991 Pemberton et al. ..... 29/239
5,088,173 A * 2/1992 Kromer et al. ..... 29/239
5,361,902 A * 11/1994 Abidin et al. ..... 206/354
5,363,958 A * 11/1994 Horan ..... 206/356
5,433,321 A * 7/1995 Abidin et al. ..... 206/354
5,507,762 A * 4/1996 Abidin et al. ..... 606/167
5,528,811 A * 6/1996 Abidin et al. ..... 30/339
5,667,067 A * 9/1997 Gabriel ..... 206/355
5,699,908 A * 12/1997 Frye et al. ..... 206/355
5,875,532 A * 3/1999 Musgrave et al. ..... 29/239
5,875,533 A * 3/1999 Henry ..... 29/239
5,938,027 A * 8/1999 Soroff et al. ..... 206/359
6,216,868 B1 * 4/2001 Rastegar et al. ..... 206/359
6,219,923 B1 * 4/2001 Sinisi et al. ..... 30/335
7,398,880 B2 * 7/2008 Henry ..... 206/355
2007/0039844 A1 * 2/2007 Zyzelewski et al. ..... 206/363
2008/0196253 A1 * 8/2008 Ezra et al. ..... 30/124
2009/0259241 A1 * 10/2009 Nakamura ..... 606/167

* cited by examiner

*Primary Examiner*—Jason Daniel Prone

(57) ABSTRACT

A hand-held cutter with automatic blade changer which has a casing, short blades each with an aperture, a pushbutton and a plug, and the casing is composed of an outer casing, a fixed blade holder and a retractable blade holder; and it further has a blade changer which is divided into a blade unloading chamber and a blade loading chamber. The present invention has the advantages of being simple in construction and convenient to use, and allowing the users to change and dispose of the blades without touching them, thereby effectively protecting personal safety.

10 Claims, 8 Drawing Sheets

HAND-HELD CUTTER WITH AUTOMATIC BLADE CHANGER

BACKGROUND OF THE INVENTION

The present invention relates to a hand-held cutting tool and more particularly pertains to a hand-held cutter with automatic blade changer.

Hand-held cutters are generally classified into two categories, namely, for stationery purposes and for industrial purposes. Hand-held cutters for stationery purposes are office or student supplies for cutting sheets of paper. The blade for such a cutter is in the form of a strip. On the surface of the blade, a plurality of evenly spaced straight grooves is cut so that after the foremost pointed end of the blade has become blunt, the blunt pointed end of the blade can be bent and broken at the foremost groove, thereby allowing continuous use of the next sharp pointed end of the blade. When the whole strip of the blade is used up, it can be replaced by a new strip. However, the process of bending, breaking and changing must be operated by hand, and if sufficient care is not taken, the user's fingers may easily be injured. Further, during the process of bending and breaking, the blunt end of the blade may spring out causing injuries. Improper disposal of the discarded blunt end of the blade may also easily cause accidents. These are particularly dangerous to school children.

Hand-held cutters for industrial purposes are used for cutting thicker and harder objects such as carpets and wallpaper. They are also used in woodworking, engraving, etc. The blades are shorter, thicker and in the form of a trapezoid. As the blades are more dangerous, the cutters are usually disposed with safety means to secure the blades in position. Nevertheless, the method of bending, breaking and continuous use of the blades cannot be applied to industrial cutters. Therefore, changing of the blades must be accomplished by hand piece by piece while the safety means makes it difficult to change the blades.

The prior art provides cutters with a plurality of blades stored inside the body of the cutters for replacement. However, this increases the size and weight of the cutters, which is not favorable to the cutters' basic characteristics of being hand-held tools. Furthermore, most of the changing of the blades is operated by hand and that is not safe enough. Although the prior art also provides cutters capable of automatic changing of blades, their construction is more complicated, and the cutters are composed of a plurality of parts and components so the costs of production are higher. The cutters are larger in size and heavier in weight, and are not convenient to use. Disposal of the blunted blades is still required to be operated by hand and it is not sufficiently safe.

BRIEF SUMMARY OF THE INVENTION

In view of the aforesaid disadvantages now present in the prior art, the object of the present invention is to provide a hand-held cutter with automatic blade changer which is simple in construction and convenient to use, and allows the users to change and dispose of the blades without touching the blades, thereby effectively protecting personal safety.

To attain this, the present invention uses the following technical proposal:

A hand-held cutter with automatic blade changer generally comprising a casing, short blades each with an aperture, a pushbutton and a plug, which is characterized in that the casing is composed of an outer casing, a fixed blade holder and a retractable blade holder, wherein the head of the fixed blade holder is disposed with a plane surface, a projection is disposed on the plane surface, and by inserting the projection into the aperture of one of the blades, the blade can be fixed securely on the head of the fixed blade holder; the retractable blade holder is disposed with a plane surface which faces the plane surface of the fixed blade holder, the bottom of the retractable blade holder is connected by a reset spring with the bottom or the part near the bottom of the fixed blade holder, and the plane surface of the retractable blade holder can slide on the plane surface of the fixed blade holder, the retractable blade holder can retract and restore to its original position as against the fixed blade holder by means of the reset spring; on one side of the bottom or the part near the bottom of the fixed blade holder an opening is disposed, and the pushbutton is disposed with an inserting member for connection which has a fastening block on the surface near the pushbutton, in the center of the inserting member for connection a spring is disposed, one end of the spring is exposed from the inserting member for connection, and the inserting member for connection, together with the spring, is inserted into and connected with the opening; the bottom of the outer casing is disposed with a sliding groove which has at least two positioning slots, the fixed blade holder and the retractable blade holder are entirely and completely inserted from the bottom of the outer casing into the outer casing, the inserting member for connection is partly inserted into the sliding groove, the pushbutton is exposed from the outer casing outside the sliding groove, the plug covers and closes the bottom of the outer casing, and the sliding of the inserting member for connection in the sliding groove actuates the fixed blade holder and the retractable blade holder to slide in the outer casing, by means of the movement of the spring the fastening block of the inserting member for connection can removably engage with the positioning slots, the fixed blade holder and the retractable blade holder can slide in the outer casing till their heads are exposed from the head of the outer casing; it further comprising a blade changer which is divided into a blade unloading chamber and a blade loading chamber, each chamber is disposed with an inserting cavity near the top, the lower half of each inserting cavity is disposed with a stopping block, the fixed blade holder must be positioned on the top and the retractable blade holder must be positioned at the bottom so that the fixed blade holder and the retractable blade holder together can be inserted into the inserting cavity, and the stopping block can just block the front end of the retractable blade holder, thereby causing the retraction of the retractable blade holder; the blade loading chamber is disposed with a limiting member which only allows horizontal overlapping placement of a plurality of new blades, the end of which having the aperture is positioned near the stopping block, and the blade changer has a bottom cover which is disposed with a compression spring in position that corresponds to the new blades, the compression spring exerts force upward against the new blades so that the topmost new blade is just higher than the stopping block.

The blade unloading chamber is disposed with a stopping plate at the inserting cavity, the stopping plate is connected with and disposed inside the blade unloading chamber by a torsion spring, the stopping plate removably covers the inserting cavity, and when the fixed blade holder is inserted into the inserting cavity, the stopping plate is pushed open, and when the fixed blade holder is removed from the inserting cavity, the force of the torsion spring actuates the stopping plate to restore to its original position immediately, the stopping plate therefore prevents the old blades from falling out from the inserting cavity.

The fixed blade holder and the retractable blade holder each can be semielliptical in shape respectively, and when the plane surface of the retractable blade holder engages with the plane surface of the fixed blade holder, they together are in the shape of an ellipse.

The fixed blade holder and the retractable blade holder each can be semicircular in shape respectively, and when the plane surface of the retractable blade holder engages with the plane surface of the fixed blade holder, they together are in the shape of a circle.

The fixed blade holder and the retractable blade holder can be in any other shape.

The outer casing can be in the shape of a circular cylinder, an elliptical cylinder or a rectangular cylinder or in any other shape.

The blade changer can be in the shape of a box or in any other shape.

The shape and dimension of the inserting cavity correspond to the shape and dimension of the inserting sections of the fixed blade holder and the retractable blade holder.

The upper half of the inserting cavity of the blade loading chamber is disposed with a depression of size and dimension corresponding to the shape and dimension of the inserting section of the fixed blade holder so as to fix the position of the inserting section of the fixed blade holder, thereby allowing the projection to precisely pass through the aperture of the topmost new blade to fix the new blade on the head of the fixed blade holder.

The upper half of the inserting cavity of the blade unloading chamber is disposed with a depression of size and dimension corresponding to the shape and dimension of the inserting section of the fixed blade holder so as to fix the position of the inserting section of the fixed blade holder, thereby allowing easy unloading of the old blade.

The bottom cover can removably or securely engage with the bottom of the blade changer.

The bottom cover can be disposed in position that corresponds to the blade unloading chamber with one or a plurality of magnets or a magnetic layer to attract the unloaded blades at the bottom.

The sliding groove can be disposed with two positioning slots, and the first positioning slot is disposed near the bottom of the outer casing while the second positioning slot is disposed near the other end of the sliding groove; and when the fastening block of the inserting member for connection engages with the first positioning slot, the fixed blade holder and the retractable blade holder are entirely and completely disposed inside the outer casing and the blade is not exposed from the outer casing; when the fastening block of the inserting member for connection engages with the second positioning slot, the heads of the fixed blade holder and the retractable blade holder together with the blade are exposed from the head of the outer casing.

The sliding groove can be disposed with three positioning slots, and the first positioning slot is disposed near the bottom of the outer casing, the second positioning slot is disposed in the middle section of the sliding groove and the third positioning slot is disposed near the other end of the sliding groove; and when the fastening block of the inserting member for connection engages with the first positioning slot, the fixed blade holder and the retractable blade holder are entirely and completely disposed inside the outer casing and the blade is not exposed from the outer casing; when the fastening block of the inserting member for connection engages with the second positioning slot, the blade is exposed from the head of the outer casing and only a small section of each of the heads of the fixed blade holder and the retractable blade holder is exposed from the head of the outer casing; when the fastening block of the inserting member for connection engages with the third positioning slot, the heads of the fixed blade holder and the retractable blade holder together with the blade are exposed from the head of the outer casing.

The length of the sections of the respective heads of the fixed blade holder and the retractable blade holder that are exposed from the head of the outer casing is 20 centimeters.

The length of the blade that is exposed from the heads of the fixed blade holder and the retractable blade holder can be of any length.

The bottom of the retractable blade holder is disposed with a protrusion that engages with one end of the reset spring, and the bottom or the part near the bottom of the fixed blade holder is disposed with a protrusion that engages with the other end of the reset spring.

The fixed blade holder is disposed with a receiving slot that provides a cavity for the movement of the reset spring.

The fixed blade holder is disposed with a hollow that fixes the blade on the head of the fixed blade holder, and the shape and dimension of the hollow corresponds to the shape and dimension of the rear half of the blade.

The inserting member for connection is disposed with a positioning block, the opening is disposed with a corresponding limiting groove, and the positioning block is inserted into the limiting groove to limit the pushbutton not to rotate sidewise.

The pushbutton is in the shape of a clip which can clip onto another object.

An inserting groove is disposed along the outer edge of the bottom of the plug, the bottom of the outer casing is disposed with a corresponding inserting part, and the plug removably engages with the bottom of the outer casing to prevent the fixed blade holder, the retractable blade holder, the blade and the pushbutton from sliding out from the bottom of the outer casing.

The present invention operates as follows:

When the present invention is in a standby state, the fastening block of the inserting member for connection engages with the first positioning slot, the fixed blade holder and the retractable blade holder are entirely and completely disposed inside the outer casing and the blade is not exposed from the outer casing. The user can carry around or store the outer casing for use, for example, by inserting the pushbutton into the inner pocket of a tool box or a shoulder bag or the like, and the blade changer can also be stored for use.

To use the present invention, the fastening block of the inserting member for connection engages with the second positioning slot, the blade is exposed from the head of the outer casing, and a large section or only a small section of each of the heads of the fixed blade holder and the retractable blade holder is exposed from the head of the outer casing. The user can use the sharp pointed end of the blade to cut objects.

After finishing using, the user only needs to engage the fastening block of the inserting member for connection with the first positioning slot.

When the pointed end of the blade has become blunt and it is required to be replaced with a new blade, the user only needs to engage the fastening block of the inserting member for connection with the second positioning slot, or with the third positioning slot if available, and the heads of the fixed blade holder and the retractable blade holder together with the blade are exposed from the head of the outer casing. Then, insert the heads of the fixed blade holder and the retractable blade holder together with the blade into the inserting cavity of the blade unloading chamber, the fixed blade holder must be positioned on the top and the retractable blade holder must be positioned at the bottom so that the fixed blade holder and the retractable blade holder together can be inserted into the inserting cavity, otherwise the stopping block will block the front end of the fixed blade holder and the heads of the fixed blade holder and the retractable blade holder together with the blade cannot be inserted. When the heads of the fixed blade holder and the retractable blade holder together with the blade are inserted, the stopping plate is pushed open, the stopping block can just block the front end of the retractable blade holder, thereby causing the retraction of the retractable blade holder as against the fixed blade holder, and the blade is therefore entirely exposed and simultaneously it falls onto the bottom cover owing to gravity, and if the corresponding position on the bottom cover is disposed with one or a plurality of magnets or a magnetic layer, the unloaded blades will be attracted at the bottom. The user then pulls out the fixed blade holder and the retractable blade holder, the force of the torsion spring actuates the stopping plate to restore to its original position immediately, the stopping plate therefore blocks the inserting cavity and prevents the old blades from falling out from the inserting cavity. The user then inserts the heads of the fixed blade holder and the retractable blade holder into the inserting cavity of the blade loading chamber, the stopping block can just block the front end of the retractable blade holder, thereby causing the retraction of the retractable blade holder as against the fixed blade holder, the plane surface of the fixed blade holder is therefore exposed. As the compression spring of the bottom cover exerts force upward, the projection on the plane surface of the fixed blade holder then passes through the aperture of the topmost new blade, and as the topmost new blade is just higher than the stopping block, when the user pulls out the fixed blade holder and the retractable blade holder, the plane surface of the retractable blade holder will immediately fix the topmost new blade in between the plane surfaces of the fixed blade holder and the retractable blade holder. Therefore, during the whole process of changing the blades, the user is not required to touch the blades directly and the whole process is completely automatic.

When all the overlapping horizontally placed new blades in the blade loading chamber are used up, the user can dispose of the whole blade changer, and there is no need to take out from the blade changer the old blades that requires to be disposed of.

For the purposes of protecting the natural environment, the user can also open the bottom cover to dispose of the old blades and place some new blades, and the blade changer can be reused.

In comparison with the prior art, the present invention has the following advantages and effects:

First, during the whole process of changing the blades of the present invention, the user is not required to touch the blades directly and the whole process is completely automatic. Therefore, the present invention, in comparison with known art, is safe and reliable and can effectively protect personal safety.

Secondly, as the present invention is of simple construction and easy to operate, its production cost is relatively lower and it is more convenient to use.

DETAILED DESCRIPTION OF THE INVENTION

The preferred embodiments of the present invention are further described in detail with the following embodiment and the accompanying drawings.

Figure 1:
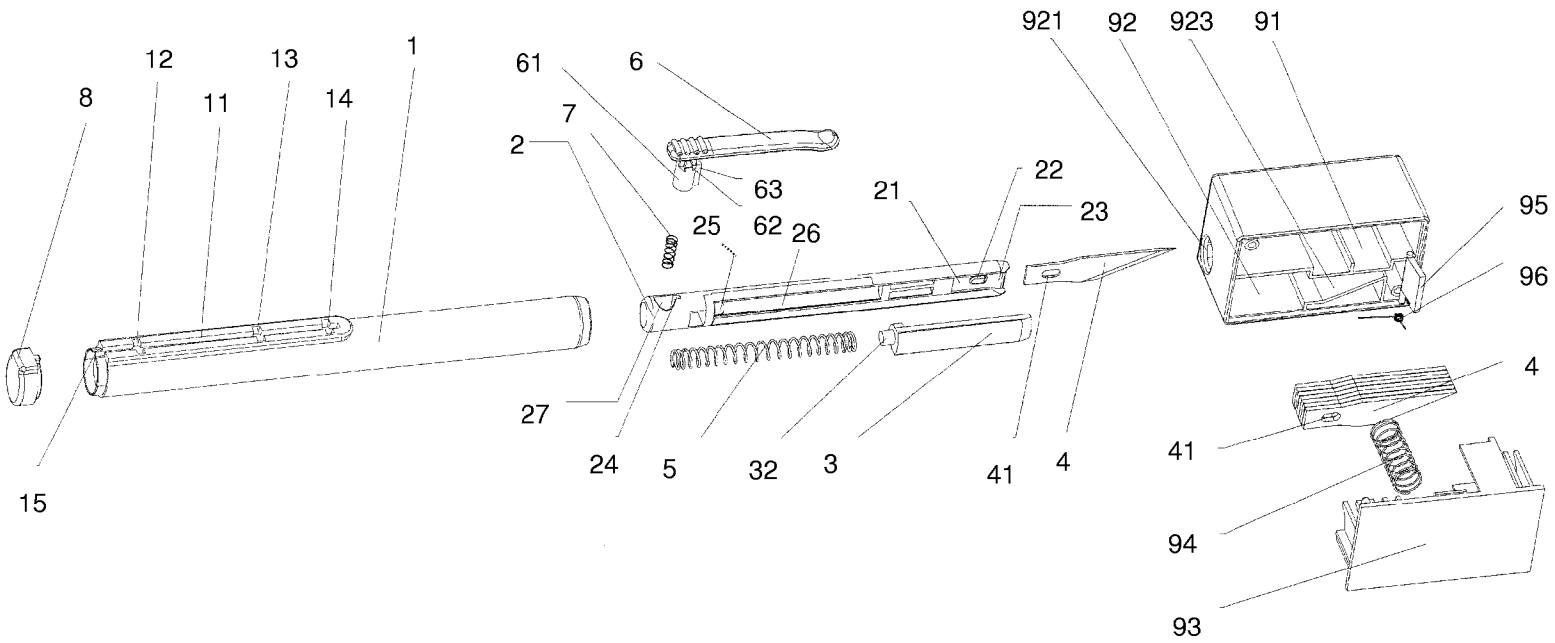
FIG. 1 is the exploded view of the embodiment of the present invention.
Figure 2:
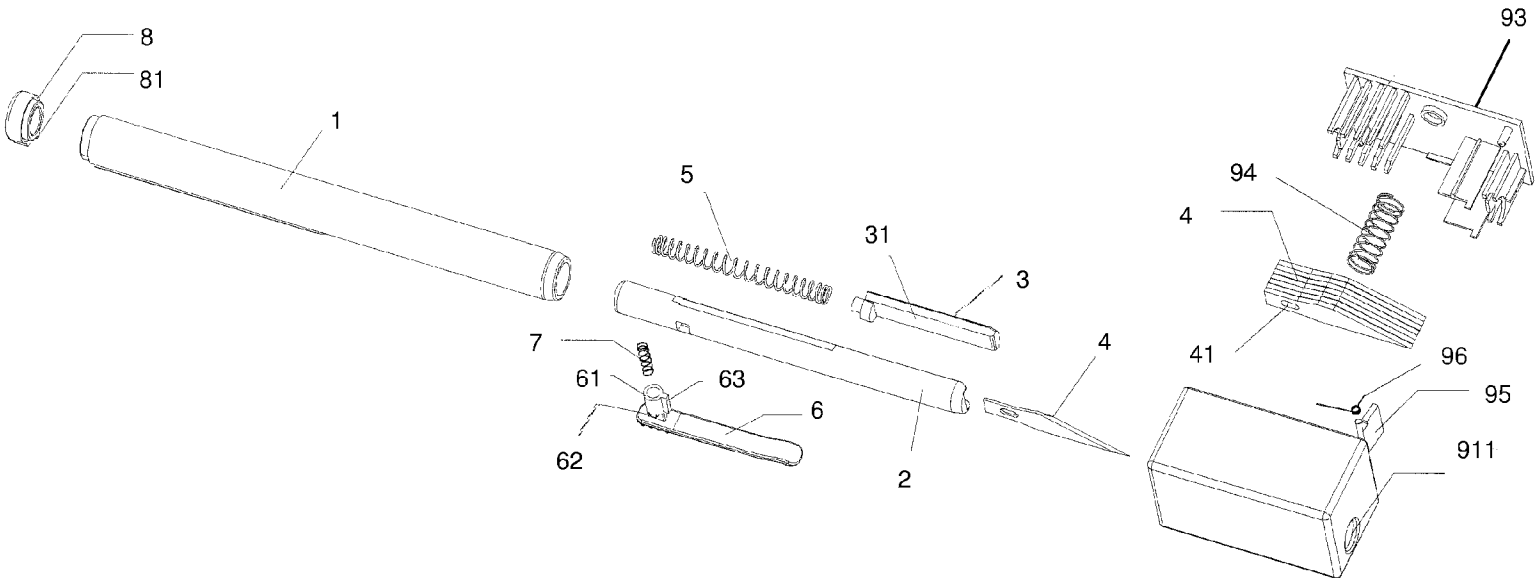
FIG. 2 is the exploded view from another angle of the embodiment of the present invention.
Figure 3:
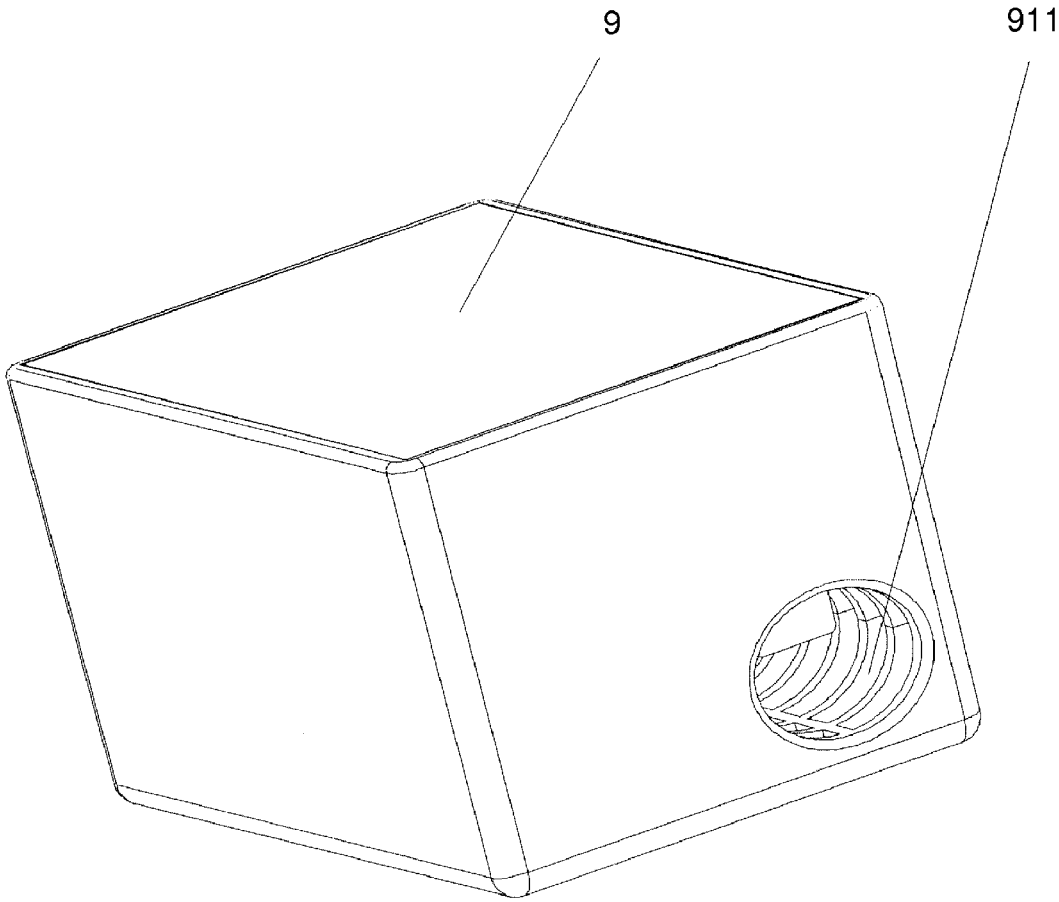
FIG. 3 is the perspective view of the blade changer of the embodiment.

FIGS. 1 to 10 illustrate the construction of an embodiment of the present invention. As shown in FIGS. 1 and 2, the embodiment comprises a casing which is composed of an outer casing 1, a fixed blade holder 2 and a retractable blade holder 3, blades 4, a reset spring 5, a pushbutton 6, a spring 7, a plug 8 and a blade changer 9. Blades 4 are short blades each with an aperture 41 and are for industrial hand-held cutters, and in this embodiment, blades of number 11 are used, while in other embodiments, other sizes of blades may be used. In this embodiment, the head of the fixed blade holder 2 is disposed with a plane surface 21, and a projection 22 is disposed on the plane surface 21, and by inserting the projection 22 into the aperture 41 of one of the blades 4, the blade 4 can be fixed securely on the head of the fixed blade holder 2. The fixed blade holder 2 is disposed with a hollow 23 that fixes the blade 4 on the head of the fixed blade holder 2, and the shape and dimension of the hollow 23 corresponds to the shape and dimension of the rear half of the blade 4. The retractable blade holder 3 is disposed with a plane surface 31 which faces the plane surface 21 of the fixed blade holder 2, the plane surface 31 of the retractable blade holder 3 can slide on the plane surface 21 of the fixed blade holder 2. The bottom of the retractable blade holder 3 is disposed with a protrusion 32 that engages with one end of the reset spring 5, and the bottom or the part near the bottom of the fixed blade holder 2 is disposed with a protrusion 25 that engages with the other end of the reset spring 5. The fixed blade holder 2 is disposed with a receiving slot 26 that provides a cavity for the movement of the reset spring 5. The retractable blade holder 3 can retract and restore to its original position as against the fixed blade holder 2 by means of the reset spring 5. In this embodiment, the fixed blade holder 2 and the retractable blade holder 3 are each semielliptical in shape respectively, and when the plane surface 31 of the retractable blade holder 3 engages with the plane surface 21 of the fixed blade holder 2, they together are in the shape of an ellipse, and in other embodiments, the fixed blade holder 2 and the retractable blade holder 3 can be semicircular in shape respectively, and when the plane surface 31 of the retractable blade holder 3 engages with the plane surface 21 of the fixed blade holder 2, they together are in the shape of a circle, or alternatively the fixed blade holder 2 and the retractable blade holder 3 can be in any other shape. These are not shown in the accompanying drawings. An opening 27 is disposed on one side of the bottom or the part near the bottom of the fixed blade holder 2, the pushbutton 6 is disposed with an inserting member for connection 61 which has a fastening block 62 on the surface near the pushbutton 6, a spring 7 is disposed in the center of the inserting member for connection 61, one end of the spring 7 is exposed from the inserting member for connection 61, and the inserting member for connection 61 together with the spring 7 is inserted into and connected with the opening 27. The inserting member for connection 61 is disposed with a positioning block 63, the opening 27 is disposed with a corresponding limiting groove 24, and the positioning block 63 is inserted into the limiting groove 24 to limit the pushbutton 6 not to rotate sidewise. The bottom of the outer casing 1 is disposed with a sliding groove 11 which has at least two positioning slots 12, 13, and in this embodiment, the sliding groove 11 is disposed with three positioning slots 12, 13, 14, the fixed blade holder 2 and the retractable blade holder 3 are entirely and completely inserted from the bottom of the outer casing 1 into the outer casing 1, the inserting member for connection 61 is partly inserted into the sliding groove 11, the pushbutton 6 is exposed from the outer casing 1 outside the sliding groove 11. An inserting groove 81 is disposed along the outer edge of the bottom of the plug 8, the bottom of the outer casing 1 is disposed with a corresponding inserting part 15, and the plug 8 removably engages with the bottom of the outer casing 1 to prevent the fixed blade holder 2, the retractable blade holder 3, the blade 4 and the pushbutton 6 from sliding out from the bottom of the outer casing 1. The sliding of the inserting member for connection 61 in the sliding groove 11 actuates the fixed blade holder 2 and the retractable blade holder 3 to slide in the outer casing 1, by means of the movement of the spring 7 the fastening block 62 of the inserting member for connection 61 can removably engage with the positioning slots 12, 13, 14, and the fixed blade holder 2 and the retractable blade holder 3 can slide in the outer casing 1 till their heads are exposed from the head of the outer casing 1. The pushbutton 6 is in the shape of a clip which can clip onto another object. In this embodiment, the outer casing 1 is in the shape of an elliptical cylinder, while in other embodiments which are not shown in the accompanying drawings, the outer casing 1 can be in the shape of a circular cylinder, rectangular cylinder or in any other shape.

Figure 7:
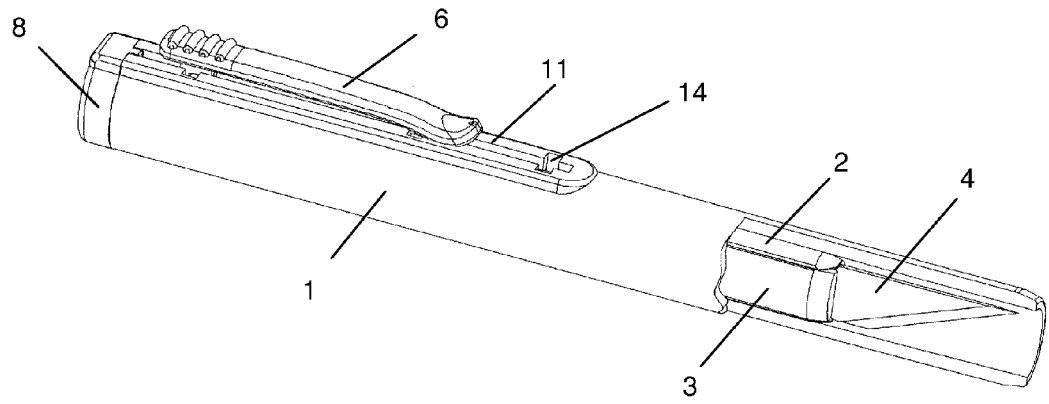
FIG. 7 is the perspective view showing the construction of the embodiment when it is in a stand-by state.
Figure 8:
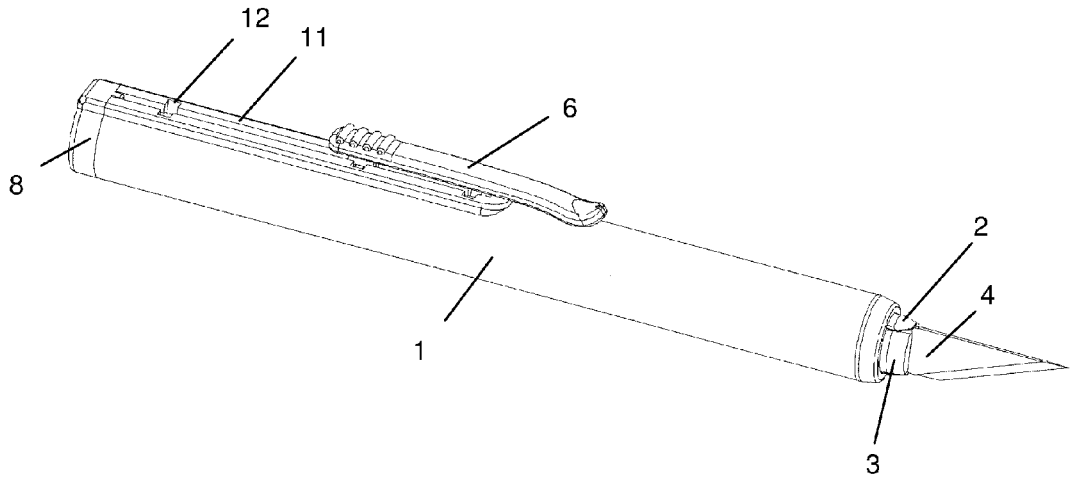
FIG. 8 is the perspective view showing the construction of the embodiment when it is in use.
Figure 9:
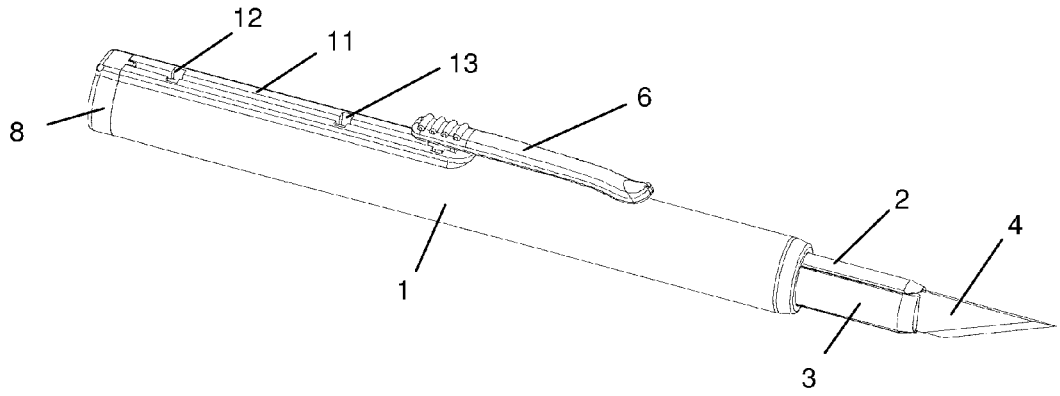
FIG. 9 is another perspective view showing the construction of the embodiment when it is in use.
Figure 10:
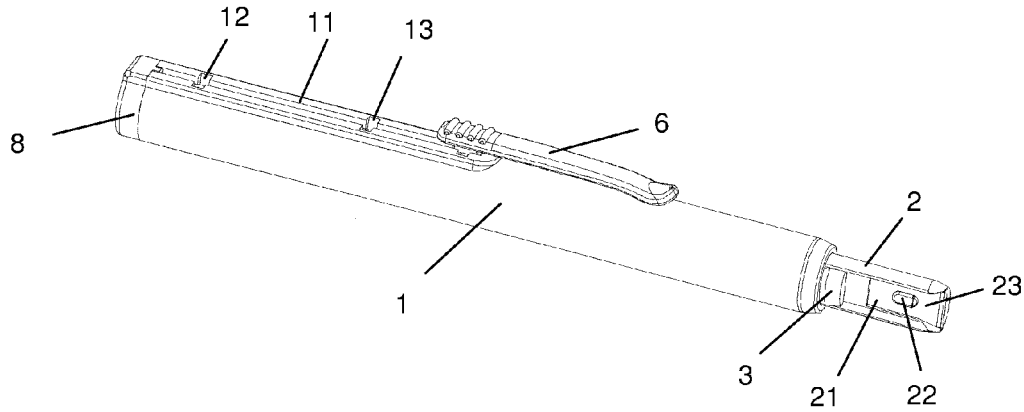
FIG. 10 is the perspective view showing the construction of the embodiment with the blade unloaded.

In this embodiment, the sliding groove 11 is disposed with three positioning slots 12, 13, 14, and the first positioning slot 12 is disposed near the bottom of the outer casing 1, the second positioning slot 13 is disposed in the middle section of the sliding groove 11 and the third positioning slot 14 is disposed near the other end of the sliding groove 11. As shown in FIG. 7, when the fastening block 62 of the inserting member for connection 61 engages with the first positioning slot 12, the fixed blade holder 2 and the retractable blade holder 3 are entirely and completely disposed inside the outer casing 1 and the blade 4 is not exposed from the outer casing 1. As shown in FIG. 8, when the fastening block 62 of the inserting member for connection 61 engages with the second positioning slot 13, the blade 4 is exposed from the head of the outer casing 1 and only a small section of each of the heads of the fixed blade holder 2 and the retractable blade holder 3 is exposed from the head of the outer casing 1. As shown in FIG. 9, when the fastening block 62 of the inserting member for connection 61 engages with the third positioning slot 14, the heads of the fixed blade holder 2 and the retractable blade holder 3 together with the blade 4 are exposed from the head of the outer casing 1. The length of the exposed sections is 20 centimeters, and in other embodiments, the length of the exposed sections can be of any other length.

In other embodiments, which are not shown in the accompanying drawings, the sliding groove 11 is disposed with two positioning slots, and the first positioning slot is disposed near the bottom of the outer casing 1 while the second positioning slot is disposed near the other end of the sliding groove 11. When the fastening block 62 of the inserting member for connection 61 engages with the first positioning slot, the fixed blade holder 2 and the retractable blade holder 3 are entirely and completely disposed inside the outer casing 1 and the blade 4 is not exposed from the outer casing 1. When the fastening block 62 of the inserting member for connection 61 engages with the second positioning slot, the heads of the fixed blade holder 2 and the retractable blade holder 3 together with the blade 4 are exposed from the head of the outer casing 1.

Figure 4:
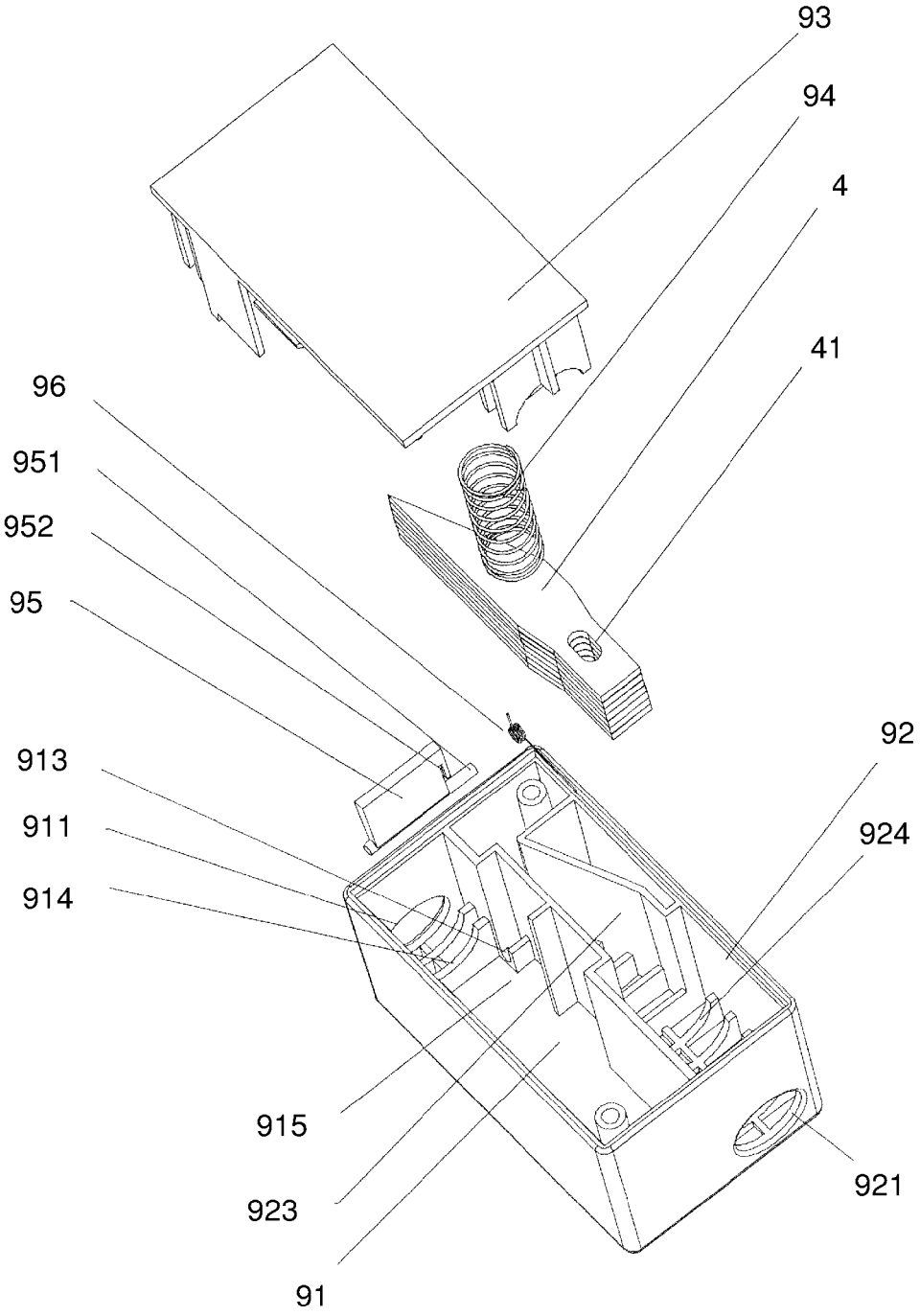
FIG. 4 is the top exploded view of the blade changer of the embodiment.
Figure 5:
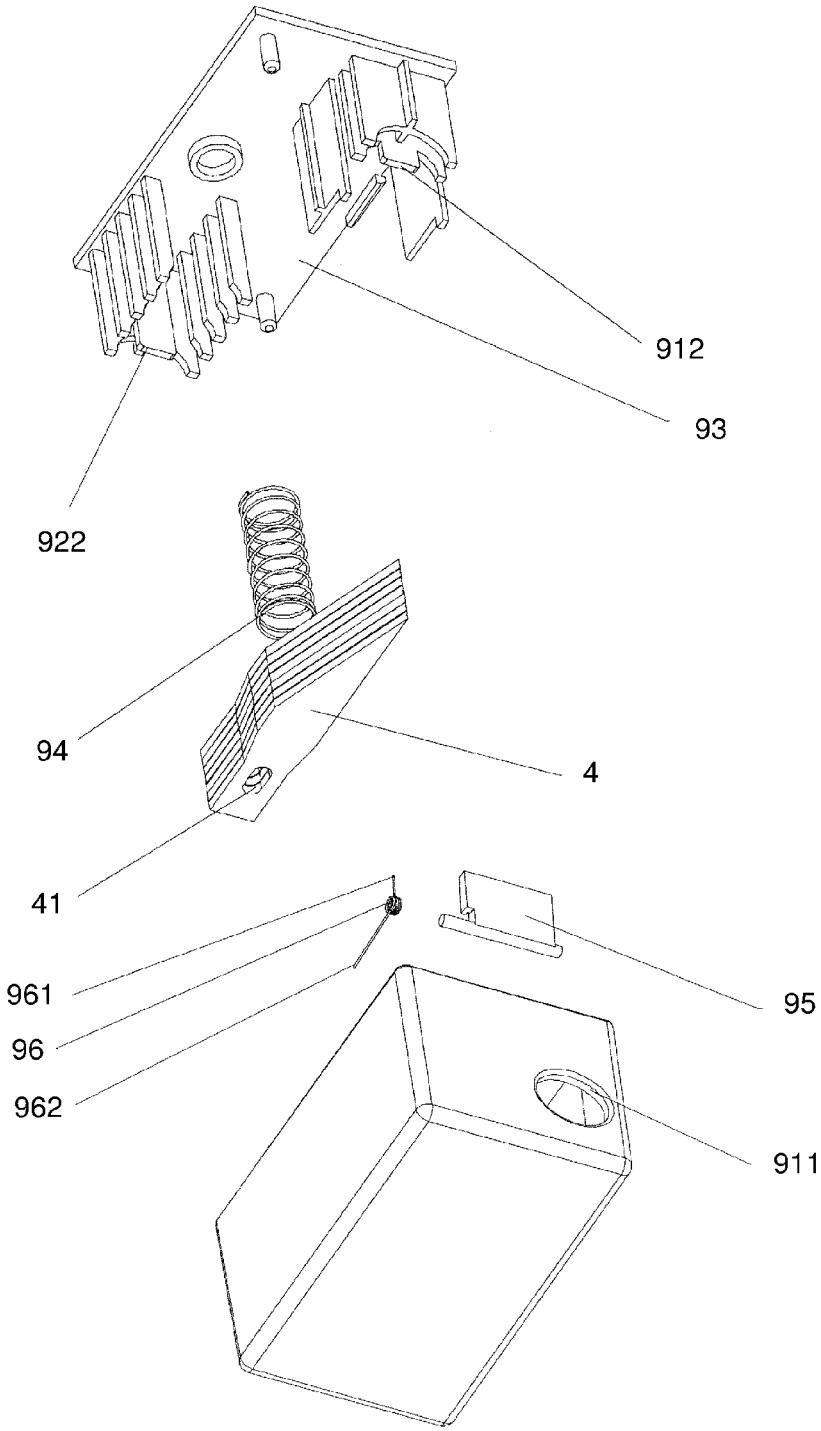
FIG. 5 is the bottom exploded view of the blade changer of the embodiment.
Figure 6:
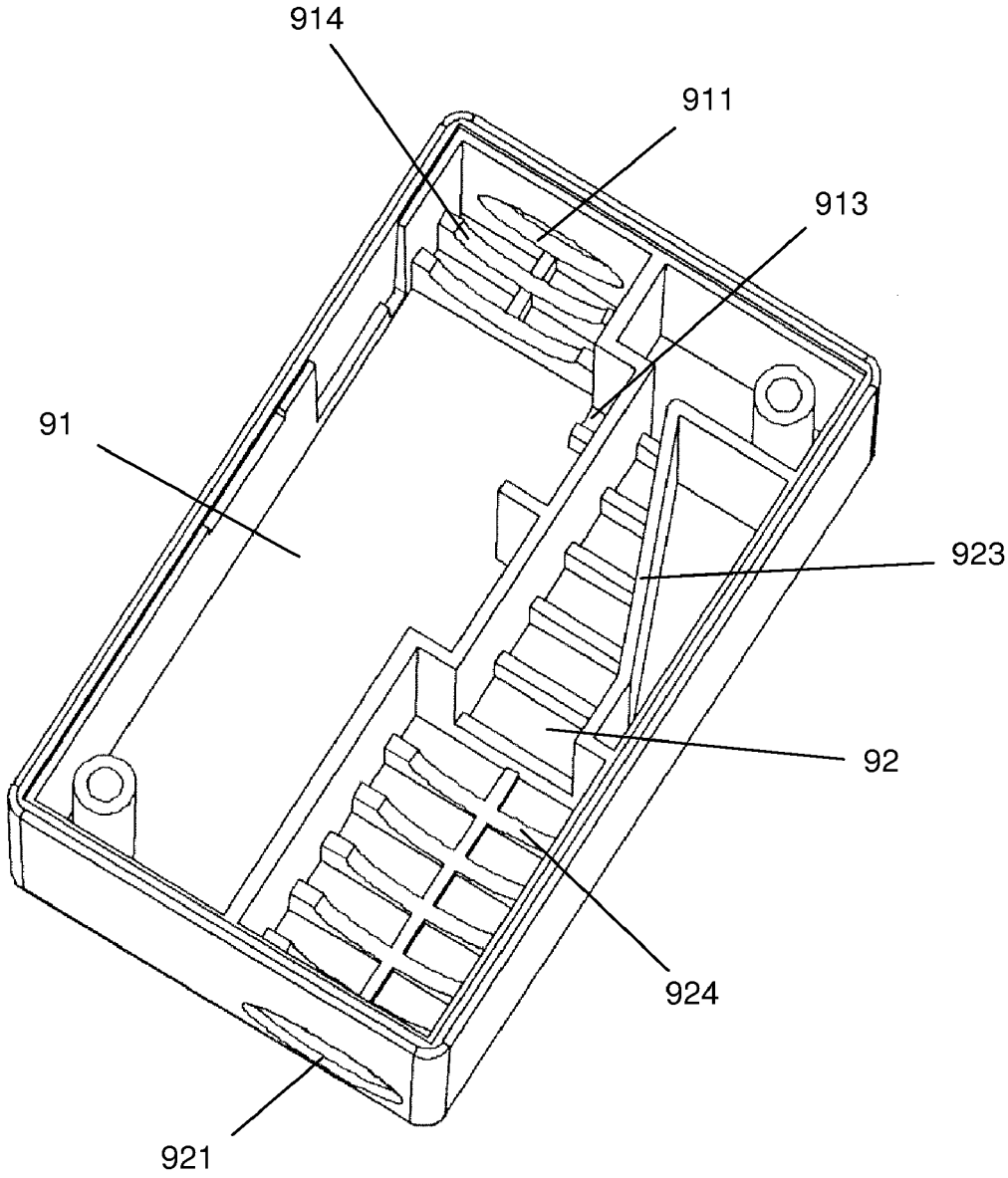
FIG. 6 is the perspective view showing the internal construction of the blade changer of the embodiment.

As illustrated in FIGS. 1 to 5, in this embodiment, the blade changer 9 is in the shape of a box, and in other embodiments which are not shown in the accompanying drawings, the blade changer 9 can be in any other shape. The blade changer 9 is divided into a blade unloading chamber 91 and a blade loading chamber 92, each chamber is disposed with an inserting cavity 911, 921 near the top, the shape and dimension of each inserting cavity 911, 921 corresponds to the shape and dimension of the inserting sections of the fixed blade holder 2 and the retractable blade holder 3. The lower half of each inserting cavity 911, 921 is disposed with a stopping block 912, 922. The fixed blade holder 2 must be positioned on the top and the retractable blade holder 3 must be positioned at the bottom so that they together can be inserted into the inserting cavity 911, 921, and the stopping block 912, 922 can just block the front end of the retractable blade holder 3, thereby causing the retraction of the retractable blade holder 3. The blade loading chamber 92 is disposed with a limiting member 923 which only allows horizontal overlapping placement of a plurality of new blades 4, the end of the new blades 4 having the aperture 41 is positioned near the stopping block 922, and the blade changer 9 has a bottom cover 93 which is disposed with a compression spring 94 in position that corresponds to the new blades 4, the compression spring 94 exerts force upward against the new blades 4 so that the topmost new blade 4 is just higher than the stopping block 922. As shown in FIGS. 4 and 5, the blade unloading chamber 91 is disposed with a stopping plate 95 at the inserting cavity 911, the stopping plate 95 is connected with and disposed inside the blade unloading chamber 91 by a torsion spring 96, the shorter end 961 of the torsion spring 96 is disposed in the depression 952 of the stopping plate 95, the longer end 962 of the torsion spring 96 leans against the plane surface 915, and the rotational shaft end 951 of the stopping plate 95 that is near the torsion spring 96 is disposed in the depression 913 of the blade unloading chamber 91. The stopping plate 95 removably covers the inserting cavity 911, and when the fixed blade holder 2 is inserted into the inserting cavity 911, the stopping plate 95 is pushed open, and when the fixed blade holder 2 is removed from the inserting cavity 911, the force of the torsion spring 96 actuates the stopping plate 95 to restore to its original position immediately, the stopping plate 95 therefore prevents the old blades from failing out from the inserting cavity 911. The upper half of the inserting cavity 921 of the blade loading chamber 92 is disposed with a depression 924 of size and dimension corresponding to the shape and dimension of the inserting section of the fixed blade holder 2 so as to fix the position of the inserting section of the fixed blade holder 2, thereby allowing the projection 22 to precisely pass through the aperture 41 of the topmost new blade 4 to fix the new blade 4 on the head of the fixed blade holder 2. The upper half of the inserting cavity 911 of the blade unloading chamber 91 is disposed with a depression 914 of size and dimension corresponding to the shape and dimension of the inserting section of the fixed blade holder 2 so as to fix the position of the inserting section of the fixed blade holder 2, thereby allowing easy unloading of the old blade 4. The bottom cover 93 can removably or securely engage with the bottom of the blade changer 9. The bottom cover 93 can be disposed in position that corresponds to the blade unloading chamber 91 with one or a plurality of magnets or a magnetic layer to attract the unloaded blades 4 at the bottom, which is not shown in the accompanying drawings.

The present invention operates as follows:

As shown in FIG. 7, when the embodiment is in a standby state, the fastening block 62 of the inserting member for connection 61 engages with the first positioning slots 12, the fixed blade holder 2 and the retractable blade holder 3 are entirely and completely disposed inside the outer casing 1 and the blade 4 is not exposed from the outer casing 1. The user can carry around or store the outer casing 1 for use, for example, by inserting the pushbutton 6 into the inner pocket of a tool box or a shoulder bag or the like, and the blade changer 9 can also be stored for use.

As shown in FIG. 8, to use the present invention, the fastening block 62 of the inserting member for connection 61 engages with the second positioning slot 13, the blade 4 is exposed from the head of the outer casing 1, and a large section or only a small section of each of the heads of the fixed blade holder 2 and the retractable blade holder 3 is exposed from the head of the outer casing 1. The user can use the sharp pointed end of the blade 4 to cut objects.

As shown in FIG. 7, after finishing using, the user only needs to engage the fastening block 62 of the inserting member for connection 61 with the first positioning slot 12.

As shown in FIG. 9, when the pointed end of the blade 4 has become blunt and it is required to be replaced with a new blade 4, the user only needs to engage the fastening block 62 of the inserting member for connection 61 with the third positioning slot 14, the heads of the fixed blade holder 2 and the retractable blade holder 3 together with the blade 4 are exposed from the head of the outer casing 1. Then, insert the heads of the fixed blade holder 2 and the retractable blade holder 3 together with the blade 4 into the inserting cavity 911 of the blade unloading chamber 91, the fixed blade holder 2 must be positioned on the top and the retractable blade holder 3 must be positioned at the bottom so that they together can be inserted into the inserting cavity 911, otherwise the stopping block 912 will block the front end of the fixed blade holder 2 and they cannot be inserted. When the heads of the fixed blade holder 2 and the retractable blade holder 3 together with the blade 4 are inserted, the stopping plate 95 is pushed open, the stopping block 912 can just block the front end of the retractable blade holder 3, thereby causing the retraction of the retractable blade holder 3 as against the fixed blade holder 2, and the blade 4 is therefore entirely exposed and simultaneously it falls onto the bottom cover 93 owing to gravity, and if the corresponding position on the bottom cover 93 is disposed with one or a plurality of magnets or a magnetic layer, the unloaded blade 4 will be attracted at the bottom. The user then pulls out the fixed blade holder 2 and the retractable blade holder 3, the force of the torsion spring 96 actuates the stopping plate 95 to restore to its original position immediately, the stopping plate 95 therefore blocks the inserting cavity 911 and prevents the old blades 4 from falling out from the inserting cavity 911. The user then inserts the heads of the fixed blade holder 2 and the retractable blade holder 3 into the inserting cavity 921 of the blade loading chamber 92, the stopping block 922 can just block the front end of the retractable blade holder 3, thereby causing the retraction of the retractable blade holder 3 as against the fixed blade holder 2, the plane surface 21 of the fixed blade holder 2 is therefore exposed. As the compression spring 94 of the bottom cover 93 exerts force upward, the projection 22 on the plane surface 21 of the fixed blade holder then passes through the aperture 41 of the topmost new blade 4, and as the topmost new blade 4 is just higher than the stopping block 922, when the user pulls out the fixed blade holder 2 and the retractable blade holder 3, the plane surface 31 of the retractable blade holder 3 will immediately fix the topmost new blade 4 in between the plane surfaces 21, 31 of the fixed blade holder 3 and the retractable blade holder 3. Therefore, during the whole process of changing the blades, the user is not required to touch the blades directly and the whole process is completely automatic.

When all the overlapping horizontally placed new blades 4 in the blade loading chamber 92 are used up, the user can dispose of the whole blade changer 9, and there is no need to take out from the blade changer 9 the old blades 4 that requires to be disposed of.

For the purposes of protecting the natural environment, the user can also open the bottom cover 93 to dispose of the old blades 4 and place some new blades 4, and the blade changer 9 can be reused.

The above embodiment is a preferred embodiment of the present invention. The present invention is capable of other embodiments and is not limited by the above embodiment. Any other variation, decoration, substitution, combination or simplification, whether in substance or in principle, not deviated from the spirit of the present invention, is replacement or substitution of equivalent effect and falls within the scope of protection of the present invention.

What is claimed is:

1. A hand-held cutter with automatic blade changer generally comprising a casing, a short blade with an aperture, a pushbutton and a plug, which is characterized in that the casing is composed of an outer casing, a fixed blade holder and a retractable blade holder, wherein a head of the fixed blade holder is disposed with a plane surface, a projection is disposed on the plane surface, and by inserting the projection into the aperture of the blade, the blade can be fixed securely on the head of the fixed blade holder; the retractable blade holder has a head and is disposed with a plane surface which faces the plane surface of the fixed blade holder, a bottom of the retractable blade holder is connected by a reset spring with a bottom or a part near a bottom of the fixed blade holder, and the plane surface of the retractable blade holder can slide on the plane surface of the fixed blade holder, the retractable blade holder can retract and restore to its original position as against the fixed blade holder by means of the reset spring; on one side of the bottom or the part near the bottom of the fixed blade holder an opening is disposed, and the pushbutton is disposed with an inserting member for connection which has a fastening block on a surface near the pushbutton, in a center of the inserting member for connection a spring is disposed, one end of the spring is exposed from the inserting member for connection, and the inserting member for connection, together with the spring, is inserted into and connected with the opening; a bottom of the outer casing is disposed with a sliding groove which has at least two positioning slots, the fixed blade holder and the retractable blade holder are entirely and completely inserted from the bottom of the outer casing into the outer casing, the inserting member for connection is partly inserted into the sliding groove, the pushbutton is exposed from the outer casing outside the sliding groove, the plug covers and closes the bottom of the outer casing, and sliding of the inserting member for connection in the sliding groove actuates the fixed blade holder and the retractable blade holder to slide in the outer casing, by means of movement of the spring the fastening block of the inserting member for connection can removably engage with the positioning slots, the fixed blade holder and the retractable blade holder can slide in the outer casing till the heads of the fixed blade holder and the retractable blade holder are exposed from a head of the outer casing; the hand-held cutter with automatic blade changer further comprising a blade changer which is divided into a blade unloading chamber and a blade loading chamber, each chamber is disposed with an inserting cavity near a top, a lower half of each inserting cavity is disposed with a stopping block, the fixed blade holder must be positioned on top and the retractable blade holder must be positioned on bottom so that the fixed blade holder and the retractable blade holder together can be inserted into the inserting cavity, and the stopping block can just block a front end of the retractable blade holder, thereby causing retraction of the retractable blade holder; the blade loading chamber is disposed with a limiting member which only allows horizontal overlapping placement of a plurality of new short blades, an end of which having the aperture is positioned near the stopping block, and the blade changer has a bottom cover which is disposed with a compression spring in position that corresponds to the new short blades, the compression spring exerts force upward against the new short blades so that a topmost new short blade is just higher than the stopping block.

2. The hand-held cutter with automatic blade changer as in claim 1, wherein the blade unloading chamber is disposed with a stopping plate at the inserting cavity, the stopping plate is connected with and disposed inside the blade unloading chamber by a torsion spring, the stopping plate removably covers the inserting cavity.

3. The hand-held cutter with automatic blade changer as in claim 1, wherein the fixed blade holder and the retractable blade holder each is semielliptical or semicircular in shape respectively, and when the plane surface of the retractable blade holder engages with the plane surface of the fixed blade holder, they together are in a shape of an ellipse or a circle.

4. The hand-held cutter with automatic blade changer as in claim 1, wherein the inserting cavity correspond to the inserting sections of the fixed blade holder and the retractable blade holder in terms of shape and dimension.

5. The hand-held cutter with automatic blade changer as in claim 1, wherein an upper half of all or any one of the inserting cavities of the blade loading chamber and the blade unloading chamber is disposed with a depression of size and dimension corresponding to the inserting section of the fixed blade holder in terms of shape and dimension.

6. The hand-held cutter with automatic blade changer as in claim 1, wherein the sliding groove is disposed with two positioning slots, and the first positioning slot is disposed near the bottom of the outer casing while the second positioning slot is disposed near an other end of the sliding groove; and when the fastening block of the inserting member for connection engages with the first positioning slot, the fixed blade holder and the retractable blade holder are entirely and completely disposed inside the outer casing and the blade is not exposed from the outer casing; when the fastening block of the inserting member for connection engages with the second positioning slot, the heads of the fixed blade holder and the retractable blade holder together with the blade are exposed from the head of the outer casing.

7. The hand-held cutter with automatic blade changer as in claim 1, wherein the sliding groove is disposed with three positioning slots, and the first positioning slot is disposed near the bottom of the outer casing, the second positioning slot is disposed in a middle section of the sliding groove and the third positioning slot is disposed near an other end of the sliding groove; and when the fastening block of the inserting member for connection engages with the first positioning slot, the fixed blade holder and the retractable blade holder are entirely and completely disposed inside the outer casing and the blade is not exposed from the outer casing; when the fastening block of the inserting member for connection engages with the second positioning slot, the blade is exposed from the head of the outer casing and only a small section of each of the heads of the fixed blade holder and the retractable blade holder is exposed from the head of the outer casing; when the fastening block of the inserting member for connection engages with the third positioning slot, the heads of the fixed blade holder and the retractable blade holder together with the blade are exposed from the head of the outer casing.

8. The hand-held cutter with automatic blade changer as in claim 1, wherein a length of sections of the respective heads of the fixed blade holder and the retractable blade holder that are exposed from the head of the outer casing is 20 centimeters.

9. The hand-held cutter with automatic blade changer as in claim 1, wherein the bottom of the retractable blade holder is disposed with a protrusion that engages with one end of the reset spring, and the bottom or the part near the bottom of the fixed blade holder is disposed with a protrusion that engages with an other end of the reset spring.

10. The hand-held cutter with automatic blade changer as in claim 1, wherein the fixed blade holder is disposed with a receiving slot that provides a cavity for movement of the reset spring.

* * * * *